US006543581B1

(12) United States Patent
Durand et al.

(10) Patent No.: US 6,543,581 B1
(45) Date of Patent: Apr. 8, 2003

(54) DOOR OPERATOR ASSEMBLY WITH MOTORIZED ROLLERS

(75) Inventors: Christophe Durand, Cernoy en Berry (FR); Pascal Rebillard, Gien (FR); Thierry Bongibault, Ouzouer sur Loire (FR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/604,376

(22) Filed: Jun. 27, 2000

Related U.S. Application Data

(63) Continuation-in-part of application No. 09/220,462, filed on Dec. 23, 1998.

(51) Int. Cl.[7] ..... B66B 13/14

(52) U.S. Cl. ..... 187/316; 49/360

(58) Field of Search ..... 187/316; 49/118, 49/120, 116, 122, 360; 310/12, 13; 318/453, 454, 466–470, 486, 685, 696

(56) References Cited

U.S. PATENT DOCUMENTS

| | | | | | |
|---|---|---|---|---|---|
| 2,303,263 | A | * | 11/1942 | Fisher | 319/14 |
| 3,826,043 | A | * | 7/1974 | Seng | 49/360 |
| 4,065,878 | A | * | 1/1978 | Tsugane | 49/360 |
| 4,593,793 | A | * | 6/1986 | Salmon | 187/56 |
| 5,301,468 | A | | 4/1994 | Kamezaki | |
| 5,594,316 | A | * | 1/1997 | Hayashida | 320/108 |
| 5,612,518 | A | * | 3/1997 | Jaminet et al. | 187/316 |
| 5,636,714 | A | * | 6/1997 | Viola | 187/280 |
| 5,701,973 | A | * | 12/1997 | Tracey | 187/315 |
| 5,711,112 | A | | 1/1998 | Barten | |
| 5,852,897 | A | | 12/1998 | Sukale | |
| 5,896,952 | A | * | 4/1999 | Dohring et al. | |
| 6,142,260 | A | * | 11/2000 | Shin | 187/333 |

FOREIGN PATENT DOCUMENTS

| | | |
|---|---|---|
| JP | 6329374 | 11/1994 |
| JP | 06329375 | 11/1994 |
| WO | WO 00/39017 | 7/2000 |

OTHER PUBLICATIONS

3 Axis Stepper Motor Controller With Linear Interpolation (Jun. 30, 1999).*

* cited by examiner

*Primary Examiner*—Jonathan Salata
(74) *Attorney, Agent, or Firm*—Carlson, Gaskey & Olds

(57) ABSTRACT

An elevator system includes an elevator cab having doors that are movable between open and closed positions. A rail is mounted to the cab. At least one roller defines an axis of rotation and is mounted for movement along the rail. The roller is operably connected to the doors to move the doors between open and closed positions. A motor assembly is mounted for movement with the roller along the rail and has an output for providing a rotational driving force to the roller. In one embodiment, the motor drives a planetary drive assembly which drives the roller along the rail and in another embodiment the motor drives a worm gear assembly which drives the roller. Alternatively, a tree-axis torque motor generates a magnetic field that is non-perpendicular to the axis of rotation of the roller, which causes the roller to be driven along the rail.

15 Claims, 3 Drawing Sheets

DOOR OPERATOR ASSEMBLY WITH MOTORIZED ROLLERS

CROSS-REFERENCE TO RELATED APPLICATIONS

This application, Ser. No. 09/604,376 filed Jun. 27, 2000, is a continuation-in part of application Ser. No. 09/220,462 filed on Dec. 23, 1998.

BACKGROUND OF THE INVENTION

This invention relates to an improved door operator assembly having a motorized roller for opening and closing elevator doors.

Elevators are used to transport passengers and cargo between lower and upper levels in a building. An elevator typically includes a car that is movable along guide rails that are mounted within a hoistway. Once the elevator reaches the desired building level, a door operator opens both the car doors and the hoistway doors.

The car doors can be either center opening doors or side-opening doors. Center opening doors operate at faster speeds, which is advantageous for commercial buildings with heavy traffic. Side-opening doors provide a larger car area to one side of the door, which is advantageous for handicapped access or for loading and unloading large objects. Some side opening doors use two-section or telescoping doors where the outer section moves at twice the speed of the inner section. This allows a larger door opening to be utilized in a smaller car.

Typically the door operators include a drive motor, linkages connecting the motor to the doors, and a control box for controlling the opening and closing speed of the doors. Some door operators have motors that drive rollers along guide rails mounted to the elevator car. These door operators are complicated and require a lot of packaging space. The operators are also expensive and difficult to maintain. Thus, it is desirable to provide a simplified door operator that is less expensive and more compact.

SUMMARY OF THE INVENTION

An elevator system includes an elevator cab having doors that are movable between open and closed positions at different floor locations. A rail is mounted to the cab and at least one roller is mounted for movement along the rail. The roller is operably connected to the doors and defines an axis of rotation. A motor assembly is mounted for movement with the roller along the rail and has an output for providing a rotational driving force to the roller. The motor rotates the roller about the axis of rotation along the rail to move the doors between open and closed positions. A controller is used to control the opening and closing speeds for the doors.

In one disclosed embodiment, the motor assembly includes at least one tree-axis torque motor having a stator supporting a winding and a rotor with an internal surface for supporting a plurality of magnets. An external surface of the rotor is formed as the roller for riding along the rail. The tree-axis torque motor generates a rotating magnetic field that is non-perpendicular to the axis of rotation. The magnetic field causes the rotor rotate with respect to the stator resulting in the roller moving along the rail.

In another disclosed embodiment, a planetary drive assembly is mounted to the motor. The planetary drive assembly has a plurality of planetary members mounted within the roller for providing a rotational input force to the roller. The output from the motor is in driving engagement with the planetary members to drive the roller along the rail.

In another disclosed embodiment, a worm gear assembly interconnects the motor and the roller. The worm gear assembly has a worm coupled to the output from the motor. The worm is in driving engagement with a worm gear formed about the circumference of the roller. The motor drives the worm, which drives the roller along the rail.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
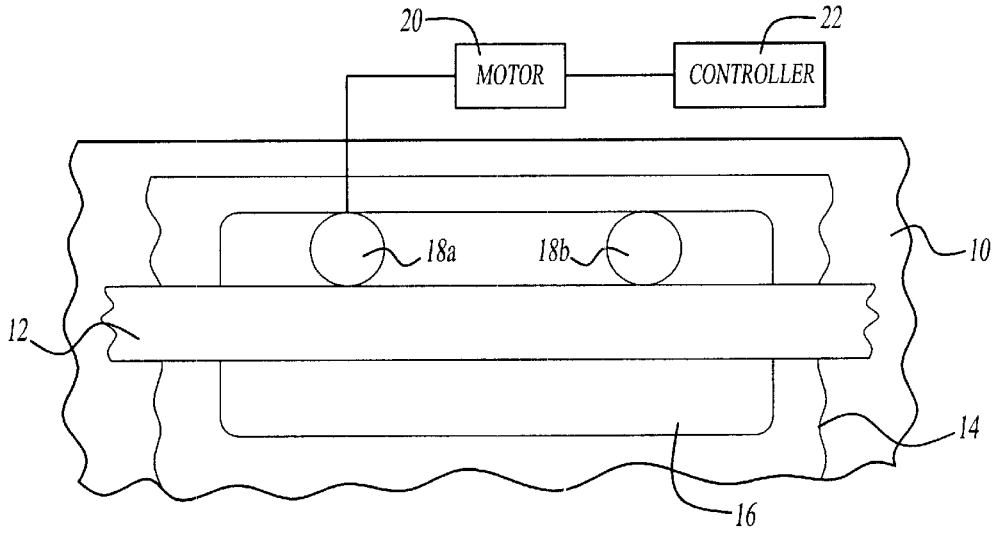
FIG. 1 is a schematic view of an elevator door utilizing the inventive motorized roller mechanism.

FIG. 1 illustrates an elevator car or cab 10 with a rail 12 supported on the car 10. A section of an elevator door 14 is supported for movement relative to the car 10 such that the door 14 can be moved between open and closed positions to allow loading and unloading of the car 10. A hanger or support bracket 16 is mounted for movement with the door 14. A set of rollers 18*a*, 18*b* are mounted to the hanger and are supported for movement along the guide rail. A motor 20 has an output that drives one of the rollers 18*a* while the other roller 18*b* is a passive roller that provides increased stability as the door 14 is moved between open and closed positions.

A controller 22 is used to control the opening and closing speed of the door 14. Typically the controller 22 is a control box having a plurality of switches (not shown) that slow the door speed down when the door 14 nears the completely closed or completely open positions. The controller 22 sends signals to the motor 20 to increase or decrease the movement speed of the door 14.

Figure 2:
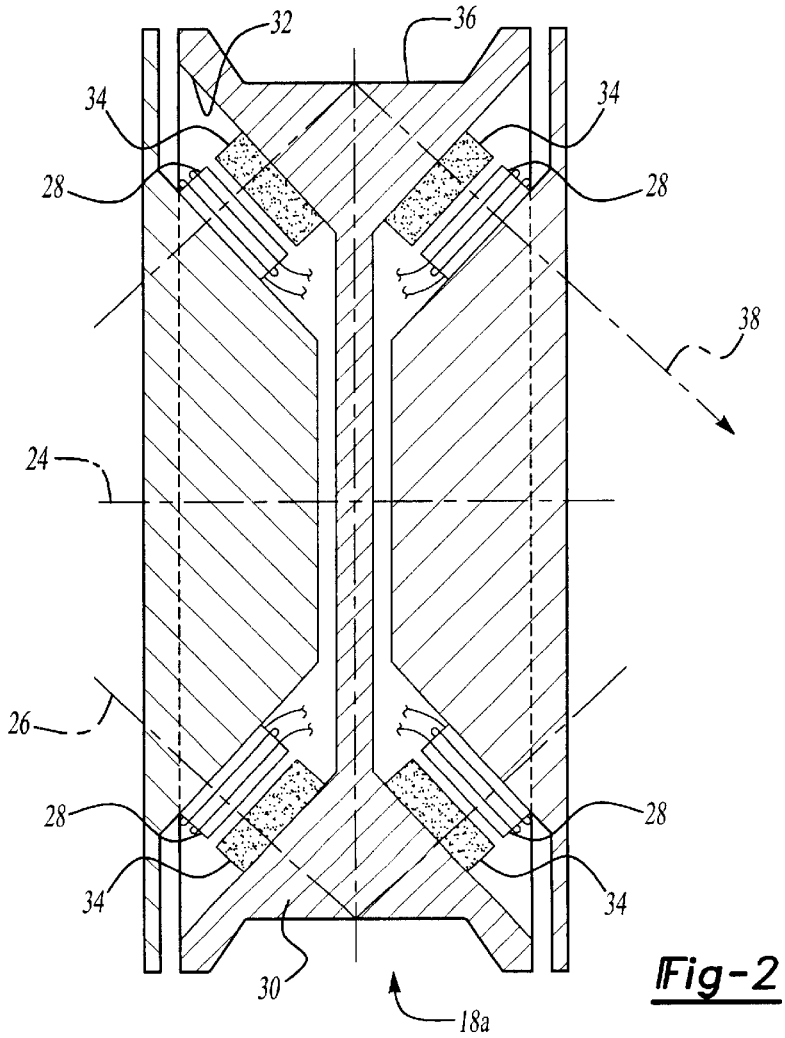
FIG. 2 is a schematic view of one embodiment of the motorized roller mechanism.

The roller 18*a* driven by the motor 20 defines an axis of rotation 24, shown in FIG. 2. In this embodiment, the motor 20 is comprised of a tree-axis torque motor having a stator 26 supporting a winding 28 and a rotor 30. The rotor 30 is formed as part of the roller 18*a* and has an internal surface 32 for supporting a plurality of magnets 34 and an external surface 36 for riding along the rail 12. The tree-axis torque motor is a synchronous motor that generates a rotating magnetic field that is non-perpendicular to the axis of rotation 24, as indicated by the arrow 38, for example. Preferably, the field is orientated at a forty-five (45) degree angle with respect to the axis of rotation 24.

The interaction between the winding 28 and magnets 34 generates the magnetic field 38 and causes the rotor 30 to rotate with respect to the stator 26, resulting in the roller 18*a* being driven along the rail 12. Preferably, a double tree-axis torque motor with both motors mounted face to face is used to improve attraction force stability created by the magnetic field 38. Both motors participate in guiding the roller 18*a*. One of the benefits of this design is that more torque is supplied for driving the roller 18*a* than can be supplied by a radial or axial motor having the same diameter.

Figure 3:
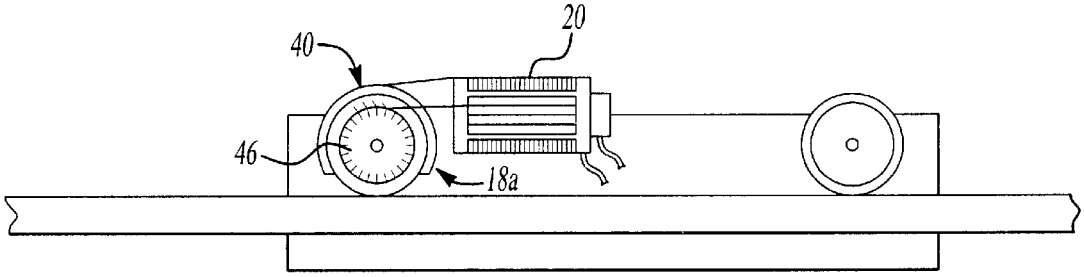
FIG. 3 is a front view of one embodiment of a motorized roller assembly incorporating a worm gear assembly.
Figure 4:
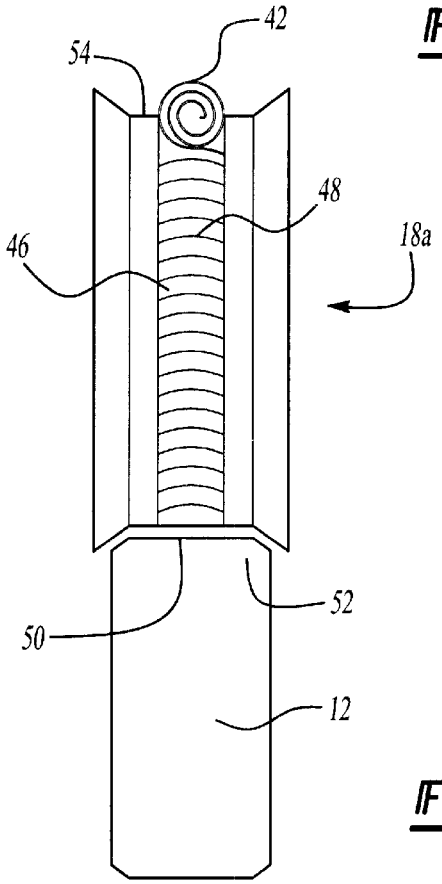
FIG. 4 is a front view of the assembly of FIG. 3.
Figure 5:
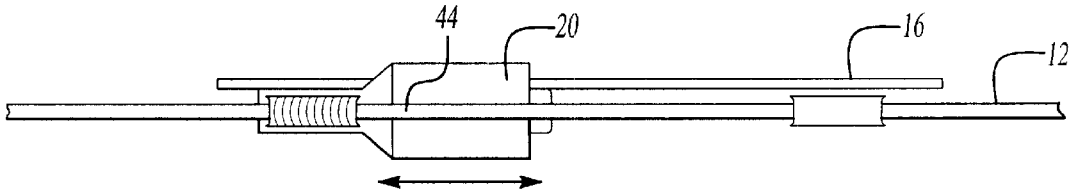
FIG. 5 is an elevational view of the assembly of FIG. 3.

In the embodiment of FIGS. 3–5, the motor 20 is connected to the roller 18*a* with a worm gear assembly 40. The worm gear assembly 40 has a worm screw 42 coupled to an output 44 from the motor 20, shown in FIG. 3. The worm screw 42 is in driving engagement with a worm gear 46 formed about the circumference of the roller 18*a*, shown in FIG. 4. Preferably, the teeth 48 of the worm gear 46 are cut directly onto the external surface of the roller 18*a*.

The rail 12 has an external ridge 50 formed along an upper edge 52 that fits into a groove 54 formed about the circumference of the roller 18*a*. The teeth 48 of the worm gear 46 are located within in the groove 54. As the motor 20 drives the worm screw 42, the worm gear 46/roller 18*a* is moved back and forth along the rail, shown in FIG. 5. Material, such as Teflon, is preferably used to ensure efficient operation of the worm screw 42 and worm gear 46. The use of a Teflon type material avoids the need for lubrication maintenance for the worm gear assembly 40. This configuration provides a simple, inexpensive, and stable mechanism for opening and closing elevator doors 14.

Figure 6:
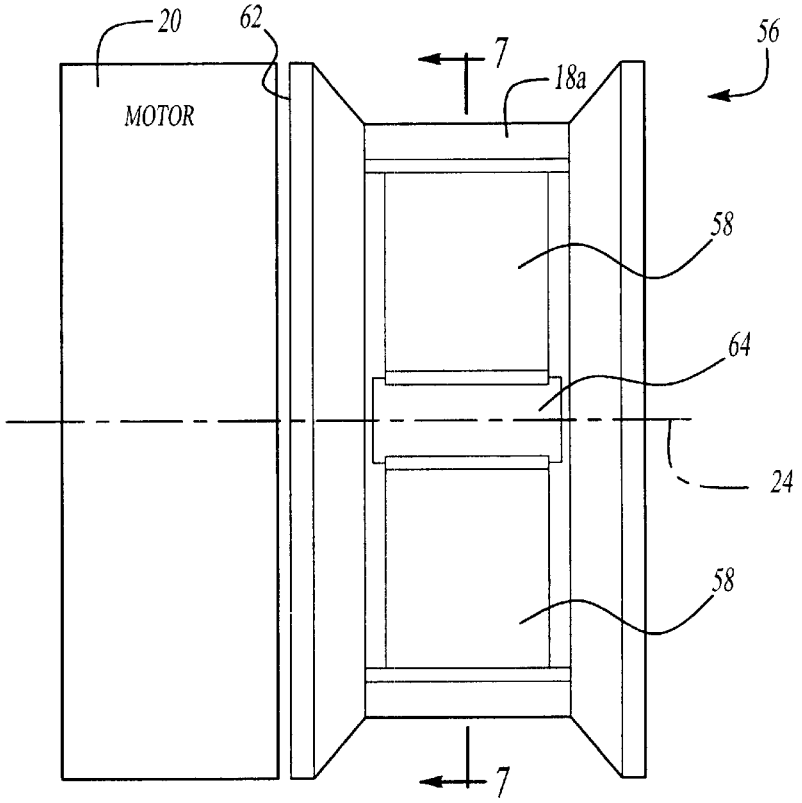
FIG. 6 is a cross-sectional view of one embodiment of a motorized roller assembly incorporating a planetary drive.
Figure 7:
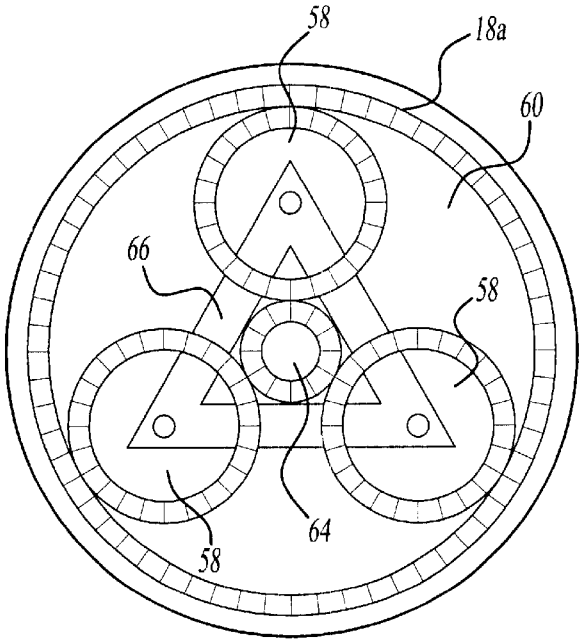
FIG. 7 is a cross-sectional view taken along line 7—7 in FIG. 6.

In an alternate embodiment shown in FIGS. 6 and 7, the motor 20 is connected to the roller 18*a* via a planetary drive assembly 56. The planetary drive assembly 56 has a plurality of disc-shaped planetary members 58 mounted within an internal pocket 60 of the roller 18*a*. In the preferred embodiment, three (3) members 58 are used, however, other configurations could also be used. The motor 20 is mounted to a side 62 of the roller 18*a* and has an output 64 that is in driving engagement with the members 58 to drive the roller 18*a* along the rail 12. The members 58 have teeth that mesh with teeth formed on the inner circumference of the roller 18*a*.

As shown in FIG. 7, a rigid support 66 interconnects the members 58. Preferably, the rigid support 66 is a triangular shaped member having each corner of the triangle mounted to a center of one of the planetary members 58. The rigid support 66 ensures that each of the members 58 is maintained at a predetermined distance apart from one another while allowing each of the members to independently rotate as the set rotates about the axis of rotation 24. This configuration provides a simple, inexpensive, and compact method for driving the rollers 18. The planetary drive assembly 56 provides for larger torque transmission from relatively small motors. This accomplishes the needed door movement with minimal noise and within less space than is possible with larger motors.

The foregoing description is exemplary rather than limiting in nature. Many modifications and variations of the present invention are possible in light of the above teachings. The preferred embodiments of this invention have been disclosed, however, one of ordinary skill in the art may recognize that certain modifications are possible that would come within the scope of this invention. It is, therefore, to be understood that within the scope of the appended claims, the invention may be practiced otherwise than as specifically described. For that reason the following claims should be studied to determine the true scope of protection given for this invention.

What is claimed is:

1. An elevator system comprising:

an elevator cab having doors that are movable between open and closed positions;

a rail mounted to said cab;

at least one roller mounted for movement along said rail and operably connected to the doors, said roller defining an axis of rotation;

a motor assembly mounted for movement with said roller along said rail and having an output for providing a rotational driving force to said roller to rotate said roller about said axis of rotation and along said rail to move the doors between open and closed positions wherein said motor assembly includes a tree-axis torque motor having a stator supporting a winding and a rotor with an internal surface for supporting a plurality of magnets and an external surface for riding along said rail wherein said tree-axis torque motor generates a rotating magnetic field that is non-perpendicular to said axis of rotation causing said rotor to rotate with respect to said stator; and a controller that controls said motor assembly to control opening and closing speeds for said doors.

2. An elevator system comprising:

an elevator cab having doors that are movable between open and closed positions;

a rail mounted to said cab;

at least one roller mounted for movement along said rail and operably connected to the doors, said roller defining an axis of rotation;

a motor assembly mounted for movement with said roller along said rail and having an output for providing a rotational driving force to said roller to rotate said roller about said axis of rotation and along said rail to move the doors between open and closed positions;

a planetary drive assembly having a plurality of planetary members mounted within said roller wherein said output from said motor is in driving engagement with said members to drive said roller along said rail; and a controller that controls said motor assembly to control opening and closing speeds for said doors.

3. An elevator system comprising:

an elevator cab having doors that are movable between open and closed positions;

a rail mounted to said cab;

at least one roller mounted for movement along said rail and operably connected to the doors, said roller defining an axis of rotation;

a motor assembly mounted for movement with said roller along said rail and having an output for providing a rotational driving force to said roller to rotate said roller about said axis of rotation and along said rail to move the doors between open and closed positions;

a worm gear assembly having a worm coupled to said output from said motor and in driving engagement with a worm gear formed about the circumference of said roller; and a controller that controls said motor assembly to control opening and closing speeds for said doors.

4. A door operator assembly for opening elevator doors comprising:

a rail mounted to an elevator cab;

at least one roller mounted for movement along said rail and operably connected to the doors, said roller defining an axis of rotation;

a motor having an output for providing a rotational driving force to rotate said roller about said axis of rotation and along said rail; and a gear arrangement interconnecting said motor and said roller for transmitting the rotational driving force from said motor to said roller to move the doors between open and closed positions wherein said gear arrangement is comprised of a planetary drive assembly having a plurality of planetary members mounted within said roller wherein said output from said motor is in driving engagement with said members to drive said roller along said rail.

5. A door operator assembly as recited in claim 4, including a rigid support interconnecting said planetary members.

6. A door operator assembly for opening elevator doors comprising:

a rail mounted to an elevator cab;

at least one roller mounted for movement along said rail and operably connected to the doors, said roller defining an axis of rotation; and at least one tree-axis torque motor having a stator supporting a winding and a rotor with an internal surface for supporting a plurality of magnets and an external surface formed as said roller for riding along said rail wherein said motor generates a rotating magnetic field that is non-perpendicular to said axis of rotation for driving said roller along said rail to move the doors between open and closed positions.

7. A door operator assembly as recited in claim 6, including a plurality of tree-axis torque motors for driving said roller along said rail with each of said motors generating a rotating magnetic field that is non-perpendicular to said axis of rotation to improve field stability.

8. An elevator system as recited in claim 1 wherein said rotating magnetic field is orientated at forty-five degrees relative to said axis of rotation.

9. An elevator system as recited in claim 1 wherein said tree-axis torque motor comprises a double tree-axis torque motor including a pair of motors mounted in a face to face configuration.

10. An elevator system as recited in claim 2 wherein said motor is mounted to a side of said roller.

11. An elevator system as recited in claim 2 wherein each of said members includes a plurality of teeth that are in meshing engagement with a plurality of roller teeth formed on an inner circumference of said roller.

12. An elevator system as recited in claim 2 including a common rigid support interconnecting each of said members.

13. An elevator system as recited in claim 12 wherein said plurality of planetary members comprises three members each having a center mounting portion and wherein said rigid support comprises a triangular shaped member with each triangular corner mounted to one of said center mounting portions of said members.

14. An elevator system as recited in claim 3 wherein said roller includes a groove formed about the circumference of said roller with said worm gear teeth being formed within said groove.

15. An elevator system as recited in claim 14 wherein said rail includes an external ridge that is received within said groove.

* * * * *